US005691046A

United States Patent [19]

Matsubara et al.

[11] Patent Number: 5,691,046

[45] Date of Patent: Nov. 25, 1997

[54] RECORDING MEDIUM

[75] Inventors: Toshiya Matsubara; Nobuyuki Yokota, both of Yokohama, Japan

[73] Assignee: Asahi Glass Company Ltd., Tokyo, Japan

[21] Appl. No.: 642,397

[22] Filed: May 3, 1996

[30] Foreign Application Priority Data

May 12, 1995 [JP] Japan ..... 7-114683

[51] Int. Cl.[6] ..... B41M 5/00

[52] U.S. Cl. ..... 428/310.5; 346/135.1; 428/195; 428/206; 428/218; 428/318.4; 428/331; 428/910

[58] Field of Search ..... 428/195, 206, 428/218, 318.4, 331, 910, 310.5; 346/135.1

[56] References Cited

U.S. PATENT DOCUMENTS

| | | | |
|---|---|---|---|
| 5,104,730 | 4/1992 | Misuda et al. | 428/304.4 |
| 5,463,178 | 10/1995 | Suzuki et al. | 428/216 |
| 5,523,149 | 6/1996 | Kijimuta et al. | 428/307.3 |

FOREIGN PATENT DOCUMENTS

| | | |
|---|---|---|
| 0 018 035 | 10/1980 | European Pat. Off. . |
| 0 500 021 | 8/1992 | European Pat. Off. . |
| 0 614 771 | 9/1994 | European Pat. Off. . |
| 0 622 244 | 11/1994 | European Pat. Off. . |

OTHER PUBLICATIONS

Database WPI, Derwent Publications, AN 86–024294, JP–A–60 245 588, Dec. 5, 1985.

Database WPI, Derwent Publications, AN 91–321353, JP–A–3 215 081, Sep. 20, 1991.

Database WPI, Derwent Publications, AN 93–088483, JP–A–05 032 414, Feb. 9, 1993.

*Primary Examiner*—Marion E. McCamish
*Assistant Examiner*—Blaine R. Copenheaver
*Attorney, Agent, or Firm*—Oblon, Spivak, McClelland, Maier & Neustadt, P.C.

[57] ABSTRACT

A recording medium comprising at least one boehmite-containing porous layer on a substrate, wherein the porous layer has pores having a pore radius of from 1 to 30 nm in a pore volume of from 0.3 to 1.2 ml/g, pores having a pore radius of from 10 to 30 nm in a pore volume of from 0.2 to 1.0 ml/g and pores having a pore radius of from 30 to 100 nm in a pore volume of not more than 0.3 ml/g, and the b-axis of a boehmite crystal is oriented vertically with respect to the surface of the substrate.

20 Claims, No Drawings

RECORDING MEDIUM

The present invention relates to a recording medium, particularly a recording medium clearly recordable by a printing system employing a dye as a coloring material, such as an ink jet system.

Recently, in order to obtain a small quantity of printed matters such as sheets for overhead projectors, it has been common to adopt a method wherein manuscripts are prepared by means of a personal computer or a word processor and printed out by a printer. As such a printer, an ink jet system is regarded as prospective since full coloring is thereby easy and it is relatively inexpensive.

As a recording medium for this case, there has been developed a film or coat paper, the surface of which is provided with an ink-receiving layer comprising a water-absorptive resin and/or an inorganic porous powder for sufficiently absorbing a large amount of ink. For example, an ink jet recording medium having porous alumina xerogel with pores having a radius of from 4 to 100 nm in an ink-receiving layer has been developed (Japanese Unexamined Patent Publication No. 245588/1985).

Further, in order to improve a color density of a printed image and to obtain a printed image of high quality, there has been developed a recording sheet provided with an absorption layer having a high transparency, which comprises mainly pseudo-boehmite characterized by having pores having a pore radius of at least 10 nm in the total pore volume of not more than 0.1 ml/g (U.S. Pat. No. 5,104,730).

The above-mentioned recording sheet provided with an absorption layer comprising pseudo-boehmite having pores having a pore radius of at least 10 nm in the total pore volume of not more than 0.1 cc/g, can produce a full color image of high quality by printing under an appropriate environment by means of an appropriate ink jet printer, but the ink-absorbing speed is deficient for some types of ink jet printers or under some printing conditions, thereby causing "beading" which results in the production of an image of poor quality. The "beading" is a phenomenon that ink droplets are bonded on the surface of a recording medium, thereby producing deformed dots.

An object of the present invention is to provide a recording medium having an ink-receiving layer having a satisfactory ink-absorbing speed without impairing the transparency of the layer.

Thus, the present invention provides a recording medium comprising at least one boehmite-containing porous layer on a substrate, wherein the porous layer has pores having a pore radius of from 1 to 30 nm in a pore volume of from 0.3 to 1.2 ml/g, pores having a pore radius of from 10 to 30 nm in a pore volume of from 0.2 to 1.0 ml/g and pores having a pore radius of from 30 to 100 nm in a pore volume of not more than 0.3 ml/g, and the b-axis of a boehmite crystal is oriented vertically to the surface of the substrate.

In the present invention, boehmite is a crystal of alumina hydrate expressed by the compositional formula, $Al_2O_3.nH_2O$ (n=1–1.5). Since boehmite is excellent in ink-absorbing properties and coloring matter fixation, a porous layer containing boehmite is suitable for an ink-receiving layer. Particularly, boehmite has a high absorptivity to a water soluble anion type dye often used in an ink jet printer, and the recording medium of the present invention is therefore particularly suitable as a recording medium for an ink jet printer.

It is necessary for the boehmite-containing porous layer used in the present invention that the pore volume of pores having a pore radius in the range of from 1 to 30 nm is from 0.3 to 1.2 ml/g. If the pore volume of pores having a pore radius in the range of from 1 to 30 nm is less than 0.3 ml/g, the ink-absorbing properties and the dye fixation are insufficient and unsatisfactory. It is more preferable that the pore volume of pores having a pore radius in the range of from 1 to 30 nm is from 0.5 to 1.2 ml/g.

It is also necessary for the boehmite-containing porous layer that the pore volume of pores having a pore radius in the range of from 10 to 30 nm is from 0.2 to 1.0 ml/g. If the pore volume of pores having a pore radius in the range of from 10 to 30 nm is less than 0.2 ml/g, the ink-absorbing speed becomes unsatisfactorily slow. On the other hand, if the pore volume of pores having a pore radius in this range exceeds 1.0 ml/g, light scattering of the boehmite-containing porous layer becomes large, thereby impairing the transparency of the porous layer and the formed image becoming unsatisfactorily whitish. It is more preferable that the pore volume of pores having a pore radius in the range of from 10 to 30 nm is from 0.3 to 0.5 ml/g.

It is further necessary for the boehmite-containing porous layer that the pore volume of pores having a pore radius in the range of from 30 to 100 nm is not more than 0.3 ml/g. If the pore volume of pores having a pore radius in the range of from 30 to 100 nm exceeds 0.3 ml/g, light scattering of the boehmite-containing porous layer becomes large, thereby impairing the transparency of the porous layer and the formed image becoming unsatisfactorily whitish. Thus, it is more preferable that pores having a pore radius exceeding 30 nm are not present so much, and that the pore volume of pores having a pore radius in the range of from 30 to 100 nm is not more than 0.1 ml/g.

In the present invention, the measurement of a pore volume is carried out by means of nitrogen adsorption-desorption method. This method can not measure precisely the pore volume of pores having a pore radius exceeding 100 nm, but it is preferable that the boehmite-containing porous layer does not substantially have pores having a pore radius exceeding 100 nm.

It is necessary for the boehmite-containing porous layer that the b-axis of a boehmite crystal is oriented substantially vertically to the surface of the substrate. If the b-axis of a boehmite crystal is not orientated vertically to the surface of the substrate, the transparency of the boehmite-containing porous layer is impaired even when the porous layer has the above-mentioned pore characteristics. "Orientation degree" used herein is determined by measuring a ratio of a reflection peak height of (200) plane/a reflection peak height of (020) plane of boehmite (formula (1)) in accordance with X-ray refraction analysis (thin film X-ray refraction method is used for a recording medium) and comparing the peak height ratio of oriented boehmite in the porous layer with a peak height ratio of non-oriented boehmite powder. Thus, the orientation degree is defined by the following formula (2).

$$\text{Peak height ratio} = \frac{\text{Peak height of (200) plane}}{\text{Peak height of (020) plane}} \quad (1)$$

$$\text{Orientation degree index} = \frac{\text{Peak height ratio of boehmite in porous layer}}{\text{Peak height ratio of non-orientated boehmite}} \quad (2)$$

If the value of the orientation degree index is 1, boehmite is non-oriented. In proportion to a decrease in this value, the vertical orientation degree becomes higher, and the value of 0 means that all of the b-axes of boehmite crystal particles are oriented vertically to the surface of the substrate, i.e. the complete b-axis orientation. If the orientation degree index of boehmite is larger than 0.5, the transparency of the boehmite layer becomes insufficient. In the case that the transparency of the boehmite layer is insufficient, haze of the medium which has a transparent substrate is unsatisfactorily high. Even in the case that the substrate employed is an opaque sheet such as paper, it is preferable that the transparency of the boehmite layer is high because dye is not fixed on the boehmite layer but in the boehmite layer. That means that it is possible to obtain a higher color density recording and a more satisfactory coloring in the case of fixing dye in the transparent boehmite layer than in the case of fixing dye in a boehmite layer having a low transparency. Thus, it is more preferable that the orientation degree index of boehmite is not larger than 0.3.

The porous layer containing the boehmite thus oriented is formed by coating a coating solution containing boehmite sol on a substrate and drying. The orientation is influenced mainly by the anisotropy of a boehmite crystal, and the b-axis of the boehmite crystal is oriented vertically to the surface of the substrate during drying step of the boehmite sol coating solution. This orientation can be achieved not only when boehmite crystal particles in the boehmite sol are in monodispersed state but also when some of sol particles are in secondarily aggregated state. However, the boehmite layer thus oriented can not be obtained simply by coating a powder obtained by pulverizing boehmite xerogel together with a binder on a substrate.

It is necessary to select such a boehmite sol as to form a porous layer having the above-mentioned pore volume characteristics, but in the case of a general boehmite sol, the pore volume of pores having a pore radius in the range of from 10 to 30 nm is deficient, and it is therefore necessary to enlarge this pore volume. For example, in the case of a boehmite sol obtained by hydrolysis method of an aluminum alkoxide, it is necessary to grow primary crystal particles to a great extent by carrying out the hydrolysis for a longer time than the hydrolysis time of a conventional boehmite sol.

The substrate employed is not specially limited, and various substrates can be used, examples of which include plastics including a polyester type resin such as polyethylene terephthalate, a polycarbonate type resin and a fluororesin such as ethylene-tetrafluoroethylene copolymer, papers and the like. Further, in addition to transparent substrates such as a plastic film or sheet and various glasses, opaque substrates such as cloth, white film, paper and metal and semitransparent substrates such as a fluororesin film including ethylene-tetrafluoroethylene copolymer or the like can also be used. These substrates may be subjected to corona discharge treatment or various surface treatments in order to improve an adhesive strength with the boehmite porous layer.

An ink-absorbing material such as paper can be used as a substrate, and a substrate such as a polyester film which does not absorb ink can also be used as a substrate. It is also possible to provide an ink-absorptive resin layer or a porous layer of a pigment such as silica between the substrate and the boehmite-containing porous layer. Further, other layers may be provided on the boehmite-containing porous layer as an upper layer.

A thickness of the boehmite-containing porous layer depends on ink-absorbing properties of a substrate, but is preferably in the range of from 1 to 50 μm. If the thickness of the boehmite-containing porous layer is less than 1 μm, it is not preferable since ink-absorbing properties become deficient or color development becomes unsatisfactory. On the other hand, if the thickness of the boehmite-containing porous layer exceeds 50 μm, it is not preferable since a mechanical strength of the porous layer becomes lower. The thickness of the boehmite-containing porous layer is more preferably from 5 to 30 μm.

It is preferable for obtaining bright color development to provide the boehmite-containing porous layer on a recording medium as the uppermost layer. Also, in order to impart a satisfactory gloss or an abrasion resistance to a recorded material, a transparent protective layer may be provided on the surface. It is preferable for the transparent surface protective layer to employ a silica gel layer having a thickness of from 0.1 to 30 μm, which has a structure comprising spherical primary particles of silica and substantially not containing secondary particles of silica in the layer.

The boehmite-containing porous layer contains boehmite preferably in an amount of at least 50 wt %. Further, it is particularly preferable for achieving bright color development to contain boehmite in an amount of at least 80 wt %. In addition to boehmite, the boehmite-containing porous layer contains preferably a binder for improving a strength of the porous layer. In addition to boehmite and binder components, the porous layer may further contain an inorganic pigment such as silica or various additives to such an extent as not to impair the characteristics of the porous layer.

As the binder, it is usually possible to employ an organic material such as starch or its modified products, polyvinyl alcohol (PVA) or its modified products, styrene butadiene rubber (SBR) latex, acrylonitrile butadiene rubber (NBR) latex, hydroxycellulose or polyvinylpyrrolidone. Among them, PVA is particularly preferable since it improves a mechanical strength of an ink-receiving layer without substantially impairing the preferable properties of boehmite. The amount of the binder is preferably from 5 to 50 wt % to the weight of boehmite. If the amount of the binder is less than 5 wt %, the strength of the porous layer is insufficient, and if the amount of the binder exceeds 50 wt %, the ink-absorbing property of the porous layer is unpreferably impaired. The amount of the binder is more preferably from 10 to 30 wt %.

As a method for providing a boehmite-containing porous layer on a substrate, it is preferable to employ a method which comprises preparing a sol-like coating solution by adding a binder and a solvent to a boehmite sol, coating the sol-like coating solution on a substrate and then drying. As the coating method, a die coater, a roll coater, an air knife coater, a blade coater, a rod coater, a bar coater, a comma coater or the like may be employed. The solvent for the slurry may be any of aqueous type or non-aqueous type solvents.

EXAMPLES

Now, the present invention will be described in further detail with reference to Examples. However, it should be understood that the present invention is by no means restricted to such specific Examples.

Example 1

900 g (50 mols) of water and 751 g (12.5 mols) of isopropanol were charged into a 2 l glass reactor (a separable flask equipped with a stirring blade and a thermometer), and were heated to a liquid temperature of 75° C. 204.25 g (1 mol) of aluminum isopropoxide was added thereto with stirring, and hydrolysis was carried out for 120 hours while maintaining the liquid temperature at 75°–78° C. Thereafter, while distilling off isopropanol, the temperature was raised to 95° C. and 6 g (0.1 mol) of acetic acid was added thereto to conduct peptization while maintaining the temperature at 95°–97° C. for 48 hours. Further, this solution was concentrated to 400 g to obtain a white boehmite sol. The sol thus obtained had a solid content of 15 wt %.

To the sol thus obtained, was added polyvinyl alcohol (saponification degree: 99.8%, polymerization degree: 4,000) in an amount of 10 wt % to the boehmite solid content, and the solution thus obtained was coated on a white polyethylene terephthalate film having a thickness of 100 μm by a bar coater, followed by drying at 140° C. to obtain a recording medium. After drying, the thickness of the coated layer was 30 μm. The orientation degree index and the pore distribution (pore volumes of pores respectively having pore radii of from 1 to 30 nm, from 10 to 30 nm and from 30 to 100 nm) are shown in the following Table 1.

Example 2 (Comparative Example)

A white boehmite sol having a solid content of 15 wt %, was prepared in the same manner as in Example 1, except that the hydrolysis time was changed from 120 hours to 24 hours. A comparative recording medium was produced in the same manner as in Example 1 by using the sol thus prepared. The orientation degree index and the pore distribution of the coated layer of this comparative recording medium are shown in the following Table 1.

Example 3 (Comparative Example)

900 g (50 mols) of water and 751 g (12.5 mols) of isopropanol were charged in a 2 l glass reactor (a separable flask equipped with a stirring blade and a thermometer), and the liquid temperature was heated to 75° C. by a mantle heater. 204.25 g (1 mol) of aluminum isopropoxide was added thereto with stirring, and hydrolysis reaction was carried out for 96 hours while maintaining the liquid temperature at 75°–78° C.

Thereafter, isopropanol was distilled off, cooled, filtrated and dried at 160° C. to obtain a boehmite xerogel. The boehmite xerogel thus obtained was pulverized to obtain white powder having an average particle size of 3 μm.

A polyvinyl alcohol aqueous solution (saponification degree: 99.8%, polymerization degree: 4,000) was added in an amount of 10 parts by weight (based on a solid content) to 100 parts by weight of the above obtained powder to prepare a coating solution having a total solid content concentration of 15 wt %. The coating solution thus prepared was coated on a white polyethylene terephthalate film having a thickness of 100 μm by a bar coater, and was dried at 140° C. to obtain a recording medium. After drying, the coating layer has a thickness of 29 μm. The orientation degree index and the pore distribution of the coated layer of this recording medium are shown in the following Table 1.

Example 4

A polyvinyl alcohol (saponification degree: 96.5%, polymerization degree: 2,600) was added in an amount of 10 wt % (based on a boehmite solid content) to the same boehmite sol having a solid content of 15 wt % as used in Example 1, and the coating solution thus prepared was coated on a fine paper of 128 g/m$^2$ by a bar coater, followed by drying at 140° C. to obtain a recording medium. After drying, the coated layer had a thickness of 25 μm. The orientation degree index and the pore distribution of the coated layer of this recording medium are shown in the following Table 1. The pore distribution of the coated layer was determined by measuring the pore distribution of the recording medium containing the substrate and the pore distribution of the substrate only and deducting the pore distribution of the substrate only from the pore distribution of the recording medium containing the substrate.

Example 5 (Comparative Example)

A polyvinyl alcohol (saponification degree: 96.5%, polymerization degree: 2,600) aqueous solution was added in an amount of 12 parts by weight (based on a solid content) to 100 parts by weight of the same boehmite powder as used in Example 3 to prepare a coating solution having a total solid content concentration of 15 wt %. The coating solution thus prepared was coated on a fine paper of 128 g/m$^2$ by a bar coater, and was dried at 140° C. to obtain a recording medium. After drying, the thickness of the coated layer was 25 μm. The orientation degree index and the pore distribution of the coated layer of this recording medium are shown in the following table 1. The pore distribution was measured in the same manner as in Example 4.

TABLE 1

| | Pore volume (cc/g) | | | Orientation |
|---|---|---|---|---|
| Example | 1–30 nm | 10–30 nm | 30–100 nm | degree |
| 1 | 0.83 | 0.32 | 0.05 | 0.21 |
| 2 | 0.63 | 0.05 | 0.02 | 0.14 |
| 3 | 0.94 | 0.45 | 0.09 | 0.96 |
| 4 | 0.70 | 0.46 | 0.02 | 0.13 |
| 5 | 0.86 | 0.63 | 0.12 | 0.96 |

Evaluation

A test pattern of 5 cm/5 cm was printed in black and green (a mixed color of cyan and yellow) on each of the recording media of Examples 1 to 5 by means of a color ink jet printer MJ-700V2C manufactured by Seiko Epson Corp. A reflection color density of the black printed pattern on each of the printed sheets was measured by a Sakura-densitometer PDA45 manufactured by Konica Corp. From the green printed pattern on each of the printed sheets, the degree of beading was relatively evaluated by four ranks from 0 to 3 (0: best, 3: worst).

TABLE 2

| Example | Color density | Beading |
|---|---|---|
| 1 | 2.13 | 0 |
| 2 | 2.21 | 1 |
| 3 | 1.84 | 0 |
| 4 | 2.28 | 0 |
| 5 | 1.85 | 0 |

The recording media of Examples 1 and 4 of the present invention provided satisfactorily high color densities and did not cause beading. On the other hand, the comparative recording medium of Example 2 provided a more satisfactory color density than the recording medium of Example 1, but caused beading. Also, the comparative recording media of Examples 3 and 5 did not cause beading, but their color densities were unsatisfactorily low.

As mentioned above, the recording medium of the present invention provides satisfactory ink-absorbing properties and an excellent color development, and is capable of rapidly absorbing ink. Thus, the recording medium of the present invention does not cause beading even when used as a recording medium for an ink jet printer. Further, when a transparent substrate is used in the present invention, a recording medium having a satisfactory transparency can be obtained.

What is claimed is:

1. A recording medium comprising at least one crystalline boehmite-containing porous layer on a substrate, wherein the porous layer has pores having a pore radius of from 1 to 30 nm in a pore volume of from 0.3 to 1.2 ml/g, pores having a pore radius of from 10 to 30 nm in a pore volume of from 0.2 to 1.0 ml/g and pores having a pore radius of from 30 nm to 100 nm in a pore volume of not more than 0.3 ml/g, and the b-axis of the boehmite is oriented vertically with respect to the surface of the substrate.

2. The recording medium according to claim 1, wherein the pore volume of the pores having a pore radius of from 1 to 30 nm is from 0.5 to 1.2 ml/g.

3. The recording medium according to claim 1, wherein the pore volume of the pores having a pore radius of from 10 to 30 nm is from 0.3 to 0.5 ml/g.

4. The recording medium according to claim 1, wherein the pore volume of the pores having a pore radius of from 30 to 100 nm is not more than 0.1 ml/g.

5. The recording medium according to claim 1, wherein the porous layer does not substantially have pores having a pore radius exceeding 100 nm.

6. The recording medium according to claim 1, wherein the boehmite has an orientation degree index of not larger than 0.5, the orientation degree index being defined by Formula 2, which is based on a peak height ratio defined by Formula 1 which is a ratio of a reflection peak height of (200) plane to a reflection peak height of (020) plane of boehmite determined in accordance with X-ray diffraction analysis:

$$\text{Peak height ratio} = \frac{\text{Peak height of (200) plane}}{\text{Peak height of (020) plane}} \qquad \text{Formula 1:}$$

$$\text{Orientation degree index} = \frac{\text{Peak height ratio of boehmite in porous layer}}{\text{Peak height ratio of non-orientated boehmite.}} \qquad \text{Formula 2:}$$

7. The recording medium according to claim 1, wherein the orientation degree index defined by the formula (2) is not larger than 0.3.

8. The recording medium according to claim 1, wherein the substrate is a plastic film.

9. The recording medium according to claim 1, wherein the substrate is opaque.

10. The recording medium according to claim 1, wherein the substrate is paper.

11. The recording medium according to claim 1, wherein the boehmite-containing porous layer has a thickness of from 1 to 50 μm.

12. The recording medium according to claim 1, wherein the boehmite-containing porous layer has a thickness of from 5 to 30 μm.

13. The recording medium according to claim 1, wherein the boehmite-containing porous layer has a silica gel layer thereon, which has a structure having spherical primary silica particles bonded each other and does not substantially contain secondary silica particles.

14. The recording medium according to claim 13, wherein the silica gel layer has a thickness of from 0.1 to 30 μm.

15. The recording medium according to claim 1, wherein the boehmite-containing porous layer contains boehmite in an amount of at least 50 wt %.

16. The recording medium according to claim 1, wherein the boehmite-containing porous layer contains boehmite in an amount of at least 80 wt %.

17. The recording medium according to claim 1, wherein the boehmite-containing porous layer comprises boehmite and a binder.

18. The recording medium according to claim 17, wherein the amount of the binder is from 5 to 50 wt % to the weight of the boehmite.

19. The recording medium according to claim 17, wherein the binder is a polyvinyl alcohol.

20. The recording medium according to claim 1, wherein the boehmite-containing porous layer is a dried coating layer of a boehmite sol-containing coating solution.

* * * * *